US005875725A

United States Patent [19]

Mizuno

[11] Patent Number: 5,875,725

[45] Date of Patent: Mar. 2, 1999

[54] EMBROIDERY DATA PROCESSING DEVICE

[75] Inventor: Mashiro Mizuno, Nagoya, Japan

[73] Assignee: Brother Kogyo Kabushiki Kaisha, Aichi-ken, Japan

[21] Appl. No.: 991,707

[22] Filed: Dec. 17, 1997

[30] Foreign Application Priority Data

Dec. 18, 1996 [JP] Japan ..... 8-338169

[51] Int. Cl.[6] ..... D05B 21/00; D05C 5/02

[52] U.S. Cl. ..... 112/102.5; 112/475.19; 364/470.09

[58] Field of Search ..... 112/102.5, 470.06, 112/475.19; 364/470.09, 470.07

[56] References Cited

U.S. PATENT DOCUMENTS 5,231,586 7/1993 Shimizu ..... 112/103 X
5,299,514 4/1994 Hayakawa et al. ..... 112/102.5

FOREIGN PATENT DOCUMENTS 2307955 12/1990 Japan .
3289989 12/1991 Japan .
422393 1/1992 Japan .

*Primary Examiner*—Peter Nerbun
*Attorney, Agent, or Firm*—Kane, Dalsimer, Sullivan, Kurucz, Levy, Eisele and Richard, LLP

[57] ABSTRACT

Disclosed is an embroidery data processing device for processing sewing data used for forming underlying stitches in a closed embroidery area defined between inside of an outer outline and outside of a plurality of inner outlines. In the embroidery data processing device, a connecting line is determined for each of the inner outlines, then the connecting line is evaluated to determined whether it is valid. If the connecting lines determined for all the inner outlines are valid, an outline of an underlying stitch area is determined based on the outer outline, inner outlines and the connecting line for each of the inner outlines.

20 Claims, 7 Drawing Sheets

EMBROIDERY DATA PROCESSING DEVICE

BACKGROUND OF THE INVENTION

The present invention relates to an embroidery data processing device for processing data to be used for forming an underlying stitch.

Conventionally, sewing data for sewing embroidery patterns is created by a skilled person such that a stitching point for each stitch cycle is determined. Recently, an embroidery data processing device which is capable of creating the sewing data automatically based on shapes, positions, sizes of embroidery patterns, direction of stitches, density of stitches and the like has been developed and widely used.

Among such data processing devices, there is a device for creating underlying stitch data which is used for performing an underlying stitch. The underlying stitch is carried out before an embroidery area is filled with embroidery stitches. By forming the underlying stitches beforehand, the embroidery stitches are formed thereupon, and the embroidery stitches can be seen to have an appropriate swell or three dimensional effect. In addition, the underlying stitches serve for preventing a work cloth from shrinking when the embroidery stitches are formed in succession on the underlying stitches. Examples of such a device are disclosed in Japanese Patent Provisional Publications HEI 2-307955, HEI 3-289989, and HEI 4-22393.

In the conventional data processing device described above, however, data processing for an area between an outline defining the outermost shape of an embroidery pattern, and outlines of areas included in the outermost outline (which will also be referred as an outer outline hereinafter) are not dealt with. Therefore, with the conventional embroidery data processing devices, it may not be possible to create appropriate sewing data for such areas under certain condition of the number, size, positions and the like of the outlines of the included areas (which will be referred to as inner outlines hereinafter).

For example, as shown in FIG. 6A, when underlying stitch data is to be created for a closed area A defined by the outermost outline OL and inner outlines IL1 and IL2 (i.e., the closed area which is inside the outermost outline OL, and outside of the inner outlines IL1 and IL2), the conventional data processing device has created the underlying stitch data as described below. Firstly, as shown in FIG. 6B, for each of inner outlines, a connecting lines is determined between another outline (for example, the outer outline). A reference point, which coincides with an end of the connecting line, is defined on each inner outline and, and a direction of the connecting line is determined to coincide with a direction similar to a predetermined direction of the underlying stitches. For example, if the direction of the underlying stitches is an up-down direction of FIG. 6B, the connecting line is determined from a lowest point of each inner outline and extends downward. Alternatively, the connecting line is determined to extend upwardly from a highest position of each inner outline. In FIG. 6B, shown is a case in which connecting lines CL1 and CL2 extend downwardly from the lowest points of the inner outlines IL1 and IL2, and respectively connect the inner outlines IL1 and IL2 with the outer outline OL.

Next, in order to prevent the underlying stitches from projecting out of the closed area A, an outline of a closed area B for the underlying stitches is determined such that the closed area (i.e., an underlying stitch area) B is apart from the closed area (i.e., an embroidery area) A by a distance "d" from the outer outline OL, inner outlines IL1 and IL2, and the connecting lines CL1 and CL2. The outline OL1 of the closed area B is shown by a broken line in FIG. 6B.

When the inner outlines IL1 and IL2 are arranged as shown in FIG. 7, and if the connecting lines CL1 and CL2 are determined as in the case shown in FIG. 6B, the outline OL1 would cross by itself as shown in FIG. 7 if the outline OL1 is defined as is done in the case shown in FIG. 6B. In such a case, it becomes impossible to identify the closed area in which the underlying stitch is to be carried out, and therefore, the underlying stitch data cannot be created.

SUMMARY OF THE INVENTION

It is therefore an object of the invention to provide an improved embroidery data processing device which is capable of creating a sewing data of an underlying stitch corresponding to an area between an outer outline, and each of a plurality of inner outlines.

For the object, according to an aspect of the invention, there is provided an embroidery data processing device for processing sewing data used for forming underlying stitches in a closed embroidery area defined between inside of an outer outline and outside of a plurality of inner outlines, the inner outlines being included inside the outer outline, the embroidery data processing device comprising: a connecting line determining system which determines a connecting line for each of the inner outlines, the connecting line connecting each of the inner outlines with one of the outer outline and the other one of the inner outlines; an evaluating system which determines whether the connecting line determined for each of the inner outlines is valid or invalid, based on a positional relationship of the connecting line extending from an inner outline with respect to the other inner outlines; and an outline creating system which creates an outline of an underlying stitch area which is to be filled with the underlying stitches, in accordance with the outer outline, the inner outlines and the connecting line for each of the inner outlines.

Since the connecting lines are examined and the outline of the underlying stitch area is created in accordance with the valid connecting lines, the underlying stitch area can be determined appropriately based on the embroidery data.

Optionally, the evaluating system may determine whether the connecting line determined for each of the inner outlines is valid or invalid based on a distance between the connecting line and the other inner outlines.

Further optionally, the evaluating system may determine whether the distance is greater than a predetermined amount, the connecting line being determined as invalid if the distance is less than the predetermined amount.

Optionally or alternatively, the connecting line determining system determines another connecting line for the inner outline if the connecting line is determined as an invalid connecting line, and an appropriate (i.e., valid) connecting line is searched.

Optionally, each of the inner outlines are regarded as successively connected line segments which are connected at defining points, the connecting line extending from one of the defining points.

Still optionally, the embroidery data processing device may include an indicating system which indicates information regarding validity of the connecting line.

Preferably or optionally, the indicating system may have a displaying device which displays message regarding validity or invalidity of the connecting line.

Optionally, the displaying device may display an error message when the connecting line for at least one of the inner outlines is determined as an invalid connecting line.

Further optionally, the outline creating system may create the outline of the underlying stitch area if the connecting line determined for each inner outline is determined as valid.

Still optionally, the embroidery data processing device further includes a data creating system which creates the sewing data used for forming the underlying stitches based on the outline of the underlying stitch area.

According to another aspect of the invention, there is provided a method for processing sewing data used for forming underlying stitches in a closed embroidery area defined between inside of an outer outline and outside of a plurality of inner outlines, the inner outlines being included inside the outer outline, the method comprising the steps of: determining a connecting line for each of the inner outlines, the connecting line connecting each of the inner outlines with one of the outer outline and the other one of the inner outlines; determining whether the connecting line determined for each of the inner outlines is valid or invalid, based on a positional relationship of the connecting line extending from an inner outline with respect to the other inner outlines; and creating an outline of an underlying stitch area which is to be filled with the underlying stitches, in accordance with the outer outline, the inner outlines and the connecting line for each of the inner outlines.

DETAILED DESCRIPTION OF THE PREFERRED EMBODIMENTS

An embodiment of the present invention will be described with reference to accompanying drawings.

Firstly, an embroidery sewing machine will be briefly described.

The sewing embroidery machine has an embroidery frame which is provided on a machine bed and holds work cloth. By a horizontal driving mechanism, the embroidery frame is driven to move in a position represented by X–Y coordinates which are defined with respect to the embroidery machine. Then the sewing machine is driven such that a sewing needle and hook rotating mechanism are driven to form a predetermined embroidery pattern on a cloth.

In such a case, the horizontal driving mechanism and/or sewing needles are controlled by a controlling device including a microcomputer or the like. If data representing moving amount in the X and Y directions (i.e., the stitch point data) are given, the controlling device automatically creates the sewing operation based on the given data.

The embroidery sewing machine is further provided with a communicating device. The embroidery data can be transmitted from an external device. The embroidery data processing device is for creating the embroidery data to be transmitted to the embroidery sewing machine.

Figure 1:
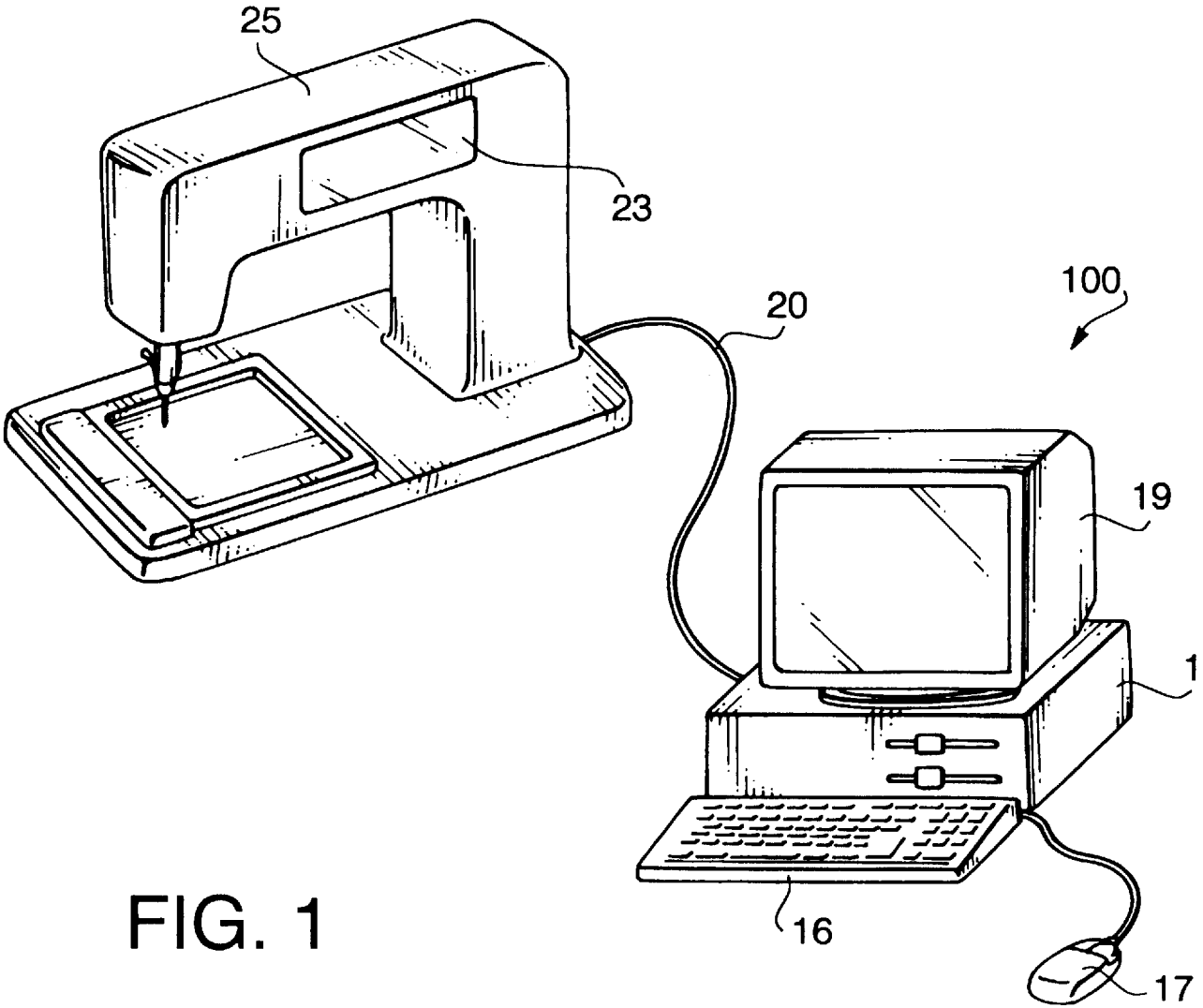
FIG. 1 is a perspective view of an embroidery data processing device and an embroidery sewing machine.

FIG. 1 shows a configuration of an embroidery sewing machine system including an embroidery data processing device 100 and an embroidery sewing machine 25.

The embroidery data processing device 100 includes, as shown in FIG. 1, a personal computer 1, a CRT (Cathode Ray Tube) 19, a keyboard 16, and a mouse 17.

An embroidery sewing machine 25 receives the embroidery data by means of a communicating device (not shown) from the personal computer 1 through a communication cable 20. Then a controller (not shown) of the sewing machine 25 controls a horizontal moving mechanism, sewing needles and the like to form an embroidery pattern based on the received embroidery data.

The embroidery sewing machine 25 is provided with a display unit 23 for displaying various messages, such as messages indicating for a user to exchange color threads to be used.

Figure 2:
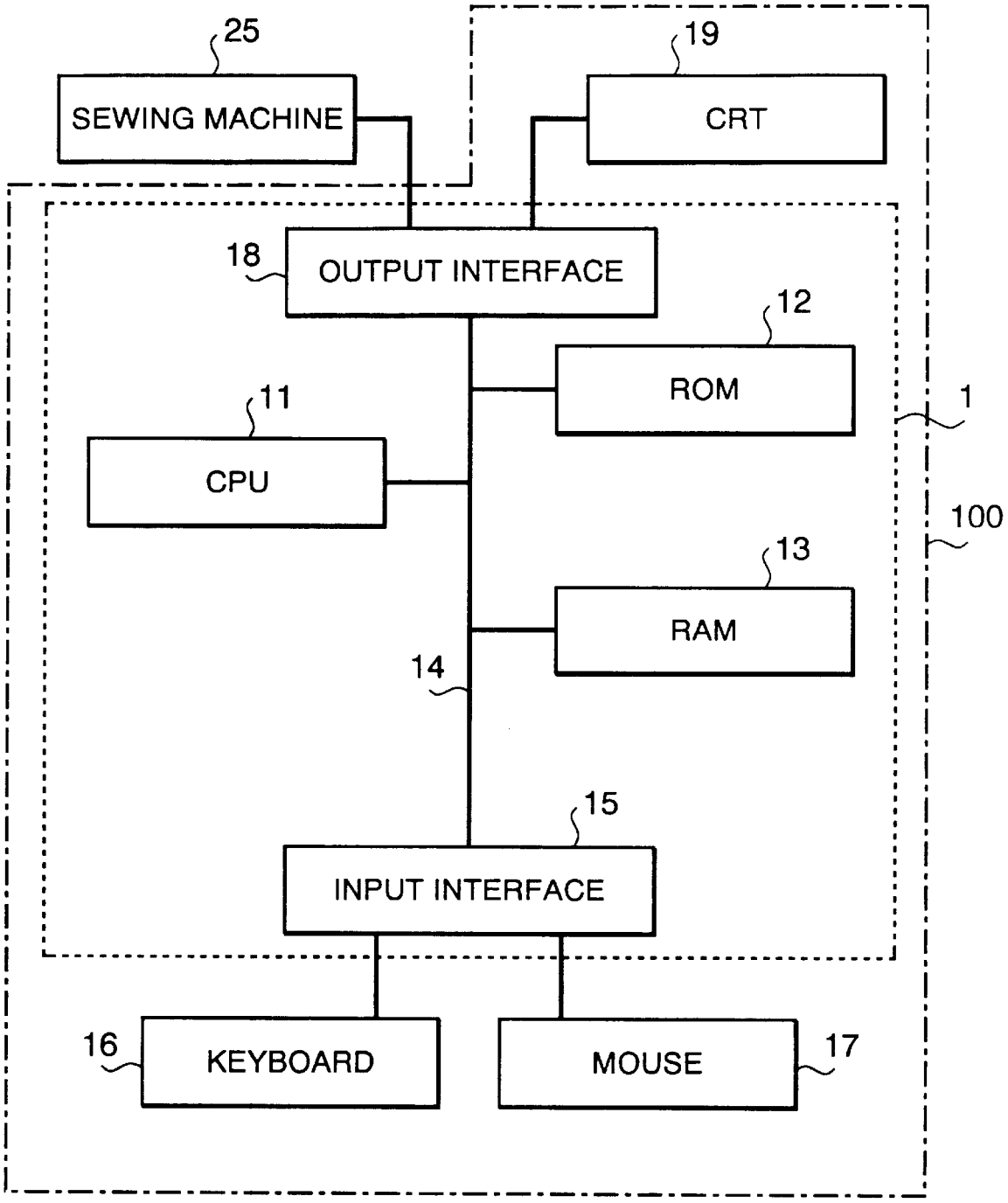
FIG. 2 is a block diagram illustrating a control system of the embroidery data processing device.

FIG. 2 is a block diagram illustrating a control system of the embroidery sewing system according to an embodiment of the present invention. As shown in FIG. 2, the embroidery sewing system is provided with the sewing machine 19 and the embroidery data processing device 100. The embroidery data processing device has the CRT 19, the personal computer 1, the keyboard 16 and the mouse 17. The personal computer 1 is provided with a CPU (Central Processing Unit) 11, a ROM (Read Only Memory) 12, a RAM (Random Access Memory) 13, an input interface 15 and an output interface 18 are interconnected through a system bus 14.

The CPU 11 controls an entire operation of the embroidery data processing device by transmitting/receiving various data and signals.

The ROM 12 stores programs of processing executed by the CPU 11 of embroidery data processing device 100.

The RAM 13 stores embroidery data input through a keyboard 16, through external storage device (not shown) and the like, and/or data generated when the programs stored in the ROM 12 are executed, and the like.

The embroidery data processing device 100 is provided with the CRT 19 which is connected through an output interface 18. On a display screen of the CRT display 19, figures showing shapes of the embroidery patterns, and various messages are displayed.

The embroidery data processing device 100 is provided with the keyboard 16 on which keys for inputting various operation commands and for selecting various operations are arranged, and as a pointing device, a mouse 17. The keyboard 16 and the mouse 17 are connected, through an input interface 15, to the CPU 11.

Further, to the embroidery data processing device 100, a communication cable 20 is connected through the output interface 18. Through the communication line 20, the embroidery data created by the embroidery data processing device 100 is transmitted to the embroidery sewing machine 25.

Figure 3:
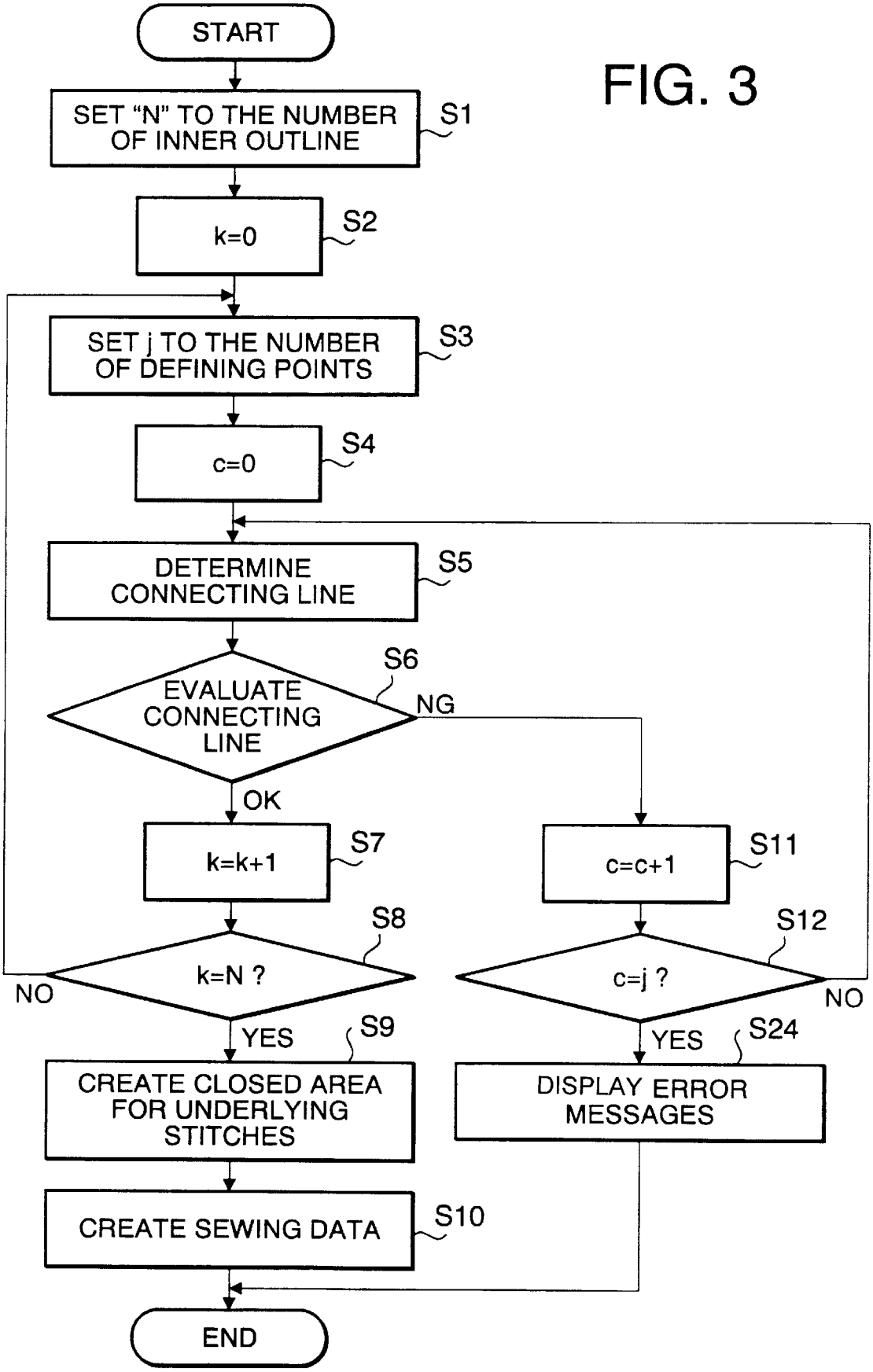
FIG. 3 is a flowchart illustrating an embroidery data creating process executed in the embroidery data processing device.

Processing executed by the CPU 11 of the embroidery data processing device 100 will be described with reference to a flowchart shown in FIG. 3.

Figure 7:
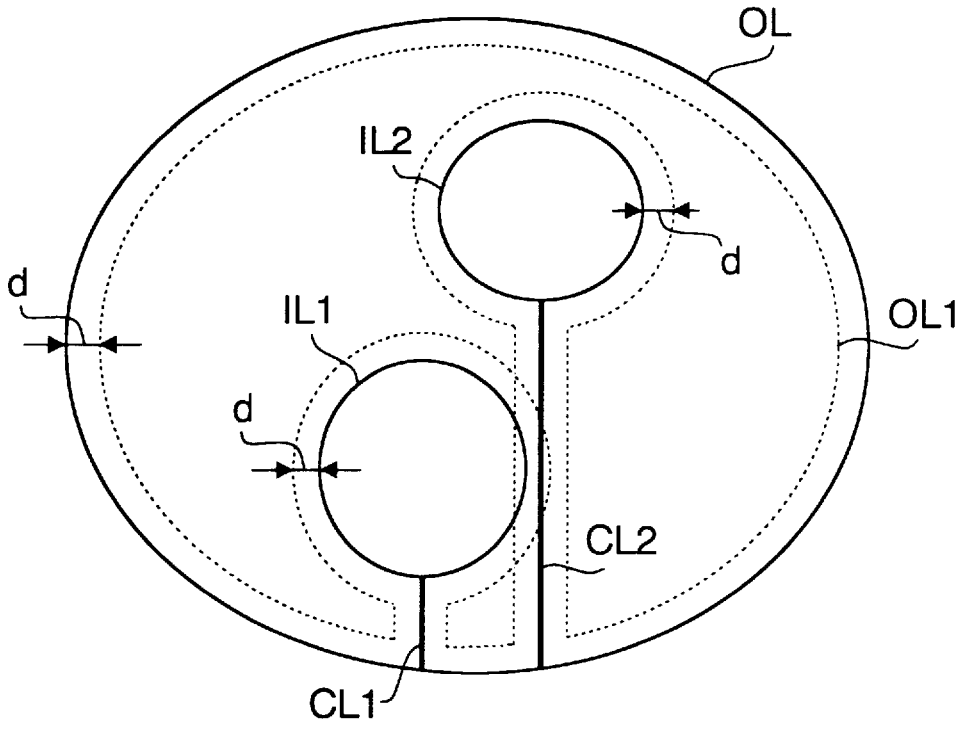
FIG. 7 PRIOR ART

The conventional data processing device was unable to create appropriate sewing data used for underlying stitch if the inner outlines are arranged as shown in FIG. 7. It should be noted that the description below relates to creation of sewing data for an area which the conventional data processing devices were unable to create.

The embroidery data processing device 100 includes the functionality of the conventional embroidery data processing device. A description of the creation of sewing data by such conventional embroidery data processing device is omitted herein.

In this example, the stitching direction of the underlying stitches is the up-down direction in FIG. 4.

When a program for embroidery data processing stored in the ROM 12 is executed, the number N is set to a number of the inner outlines which has already been stored in the RAM 12. In this example, as shown in FIG. 4, the number of the inner outlines is two, and accordingly the number N is set to 2.

The inner outlines are numbered as 1 to N from the left side one to the right side one of FIG. 4. In the following description, the number of an inner outline is indicated as ni, where i is an integer representing the number of the inner outline counted from the left-hand side of FIG. 4. The inner outlines are selected from i=1 in order. To the selected inner outline ni, a connecting line determining process is applied. Hereinafter, the selected inner outline is indicated as a "current inner outline."

At S2, the counter k corresponding to the inner outline number is initialized to have a value zero. The inner outline counter k represents the number of processed inner outlines. For the counter value k, a (k+1)-th inner outline is referred to as the current inner outline. In other words, when the counter value is k, the inner outline n (k+1) is currently selected. At an initial stage of the process, since the counter value k is 0, the inner outline n1 is selected.

At S3, the number j of defining points of the inner outline n1 is set. It should be noted that the outer outline m, the inner outlines n1, and n2 are respectively regarded to be formed by successively connected line segments connected at the defining points. Accordingly, the number j is regarded as the total number of connecting points of the line segments of each outline.

At S4, a defining point counter c which represents a defining point number of the current inner outline n1 is initialized to have a value zero. The defining point counter c is used later at S5 to determine a reference point for determining a connecting line. For all the defining points of one inner outline, a number starting from one is assigned, and a reference points is selected from the defining points in the order of the defining point number assigned thereto. For example, if a defining point counter c is currently set to i, an (i+1)-th defining point is selected as the reference point, and with respect the selected point, the connecting line is defined at S5. Then, if the set connecting point is determined to be invalid at S6, c is incremented and a new reference point is selected, and processing at steps S5 and S6 are executed.

For j defining points included in one inner outline, the numbers of 1 through j are assigned to the defining point, respectively. Note that, no two defining points have the same defining point number.

For example, number 1 is assigned to the lowest point, and the other numbers 2 through j are respectively assigned to the other defining points along the clockwise or counter-clockwise direction in order. In the present embodiment, the number 1 is assigned to the lowest point, number 2 is assigned to the highest point, number 3 is assigned to the leftmost point, and number 3 is assigned to the rightmost point, and to the other points, each of the numbers 5 through j is assigned.

At S5, with respect the inner outline n1, for example, the lowest point is determined as the initial reference point, the connecting line directed to a downward direction in the drawing to the outer outline m or another inner outline n2 is set. The direction in which the connecting line extends is the same direction as the direction of the underlying stitches which is predetermined, and further the connecting line should not project from the closed area, i.e., should not extends inside the inner outlines. When the first reference point of the inner outline n1 in FIG. 4 is the lowest point thereof, and the connecting line extends therefrom under a condition in which the stitching direction of the underlying stitches is the up-down direction in FIG. 4, the connecting line would be a line vertically extending and does not project from a closed area enclosed by the outer outline m and inner outlines n1 and n2. As above, the connecting line r1 is determined as shown in FIG. 4.

In this example, the connecting line r1 extending vertically downward from the lowest point of the inner outline n1 is connected with the outer outline m. However, depending on the positional arrangement of the inner outline n2, the connecting line r1 may connect the inner outline n2.

At S6, it is determined whether the connecting line r1 defined at S5 is valid or invalid. Specifically, it is determined whether a distance between the connecting line r1 and the other inner outlines (in this example, the outline n2) is greater than twice a predetermined distance d or not. It should be noted that the outline of the underlying stitch area can be regarded as successively connected line segments, and the predetermined distance d represents a distance between each line segment of the outer or inner outlines and a corresponding line segment of the outline of the underlying stitch area.

If the distance between the connecting line r1 and the other inner outlines (i.e., the inner outline n2) is greater than twice the predetermined distance d, the connecting line r1 is determined to be valid. If the distance between the connecting line r1 and the other inner outlines is less than twice the predetermined distance d, the connecting line r1 is determined to be invalid.

The determination is made to prevent the outline of an area in which the underlying stitches are formed from crossing over itself. Note that the outline of the underlying stitch area is determined at S9. If the outlines of the area of which the underlying stitches are formed (i.e., the underlying stitch area) crosses over itself, as indicated by broken line t1 in FIG. 4A, it becomes impossible to identify the shape of the underlying stitch area, and accordingly, the sewing data for an appropriate underlying stitches cannot be created.

If it is determined that the connecting line r1 is valid at S6, in later processing, it is possible to create appropriate sewing data for underlying stitch area. In the example shown in FIG. 4A, the connecting line r1 is apart from the inner outline n2 by twice the predetermined distance d, and accordingly the connecting line r1 is determined to be valid, and control proceeds to S7.

At S7, the counter value k of the inner outline counter is incremented by one.

Then at S8, if the counter value k is determined not to be equal to the number N, control returns to S3. In this example, at this stage, since k=1, and N=2, the processing from S3 is repeated again, and at that time the current inner outline is set to n2.

At S3, similar to the above, the number j of the defining points for the inner outline n2 is set. For example, if the inner outline n2 has 10 defining points, the value of j for the inner outline n2 is 10.

At S4, the counter value c for the current inner outline n2 is initialized to have a value 0.

Figure 4A:
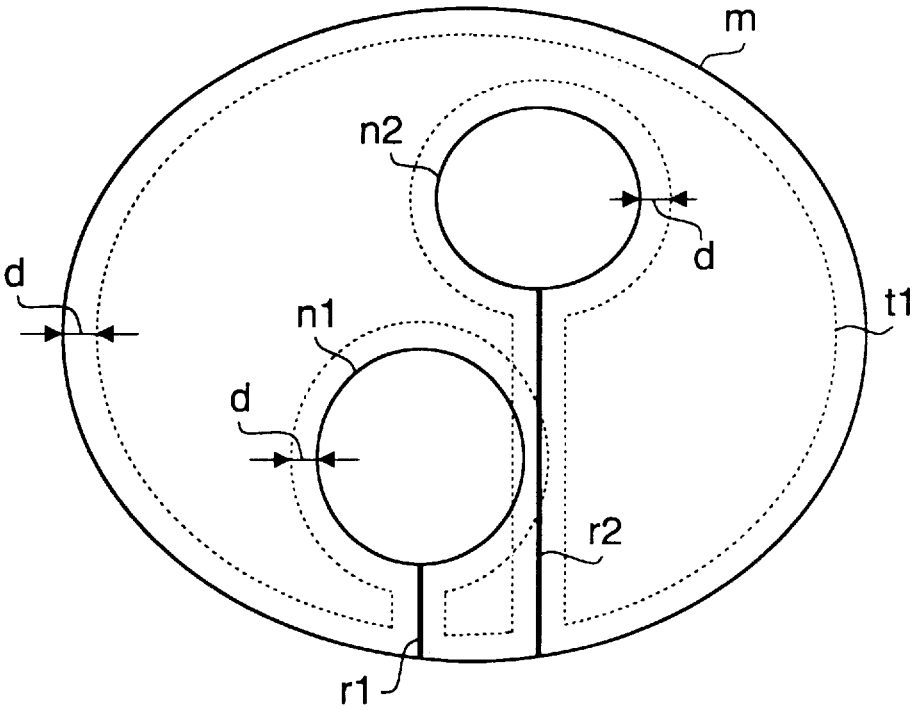
FIGS. 4A and 4B illustrate embroidery pattern outlines.

At S5, as shown in FIG. 4A, from the lowest point of the current outline n2, in a downward direction, a connecting line r2 for connecting the current inner outline n2 and the outer outline m or the inner outline n1 is determined.

At S6, it is determined whether the connecting line r2 set at S5 is valid or invalid. In this example, as shown in FIG. 4A, the distance between the connecting line r2 and the inner outline n1 is not longer than twice the predetermined distance d, the connecting line r2 is determined to be invalid and deleted, and control goes to S11.

At S11, the counter value c for the inner outline n2 is incremented by one. In other words, the reference point for the connecting line n2 is changed to another point. In this example, the lowest point is selected when the counter value c equals to 0, and the highest point is selected when the counter value c equals to 1. As above, the counter value c is incremented to c=1, the highest point is selected as a new reference point.

At S12, it is determined that the counter value c (currently equals to 1) is determined to be not equal to j (currently set to 10), and control proceeds to S5 since it is determined at S12 that the counter value c is not equal to the number j.

At S5, since the connecting line r2 is determined as the invalid connecting line at S6, another connecting line is determined for the inner outline n2. That is, as shown in FIG. 4B, a connecting line r3 which starts from the highest point of the inner outline n2 and does not project from the closed area, i.e., extends in the upward direction in FIG. 4B, is defined.

At S6, it is determined whether the newly set connecting line r3 is valid or invalid. In this case, since the distance between the connecting line r3 and the inner outline n1 is greater than twice the predetermined distance d, the connecting line r3 is determined to be valid, and control proceeds to S7.

At S7, the counter value k of the inner outline is incremented by one (k=2). Then at S8, it is determined whether the counter value k is equal to the value N. Since the counter value k is equal to the value N, control proceeds to S9.

Figure 4B:
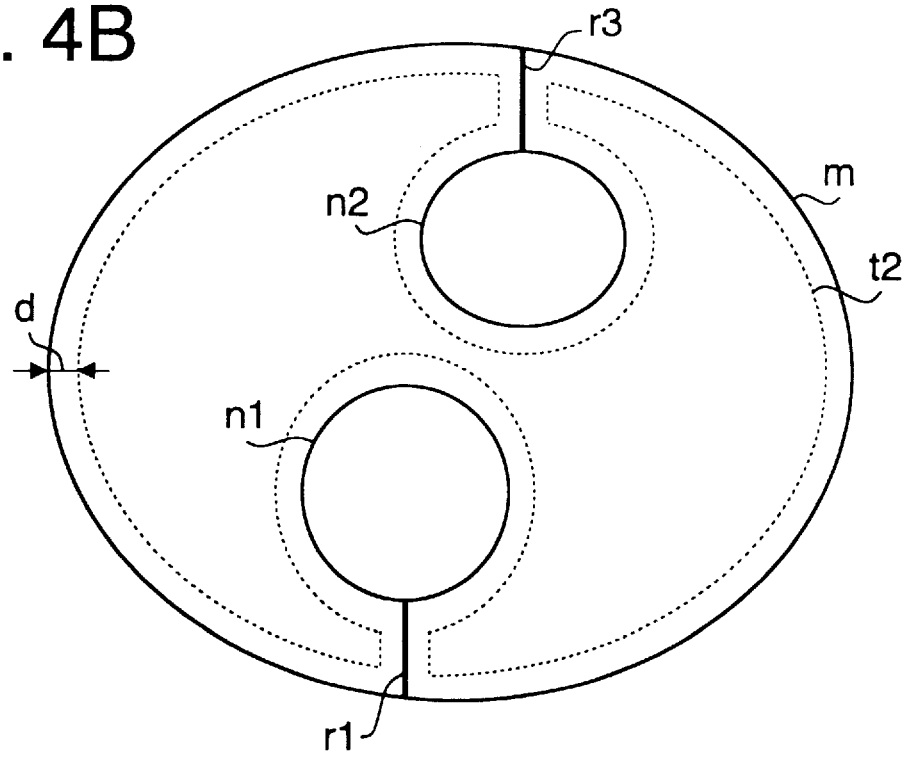

At S9, as shown in FIG. 4B, based on the outer outline m, inner outlines n1 and n2, the connecting lines r1 and r3, an outline t2 for the underlying stitch closed area is created.

At S10, based on the outline t2 of the closed underlying stitch area created at S9, the sewing data used for forming underlying stitches is created. Method of creating such a sewing data based on an outline is described, for example, in Japanese Patent Provisional Publications HEI 2-307955 and HEI 3-289989. Since the present embodiment employs the similar data create as disclosed in the above-identified publications, detailed description will be omitted.

The sewing data for forming the underlying stitches created as described above is transmitted to the embroidery sewing machine 25 through the output interface 18 and the communication cable 20 as shown in FIG. 2. Then the embroidery sewing machine 25 operates to form the underlying stitches based on the transmitted sewing data.

Figure 5:
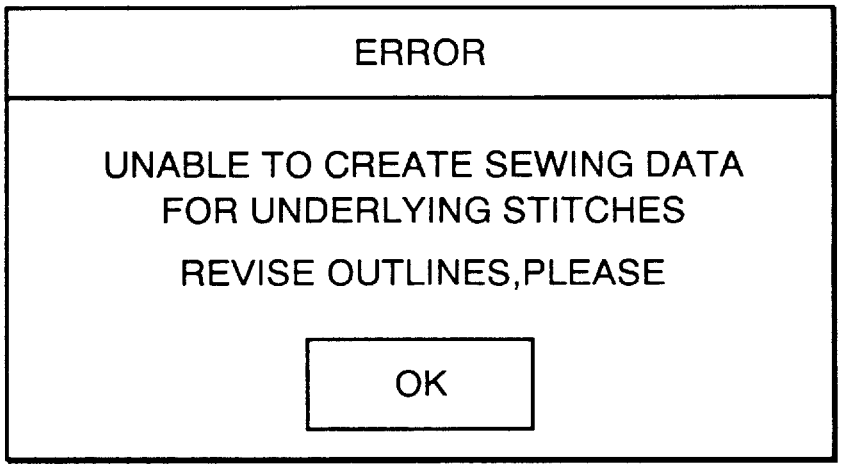
FIG. 5 show an example of a message screen which is displayed on a CRT of the embroidery data processing device.
Figure 6A:
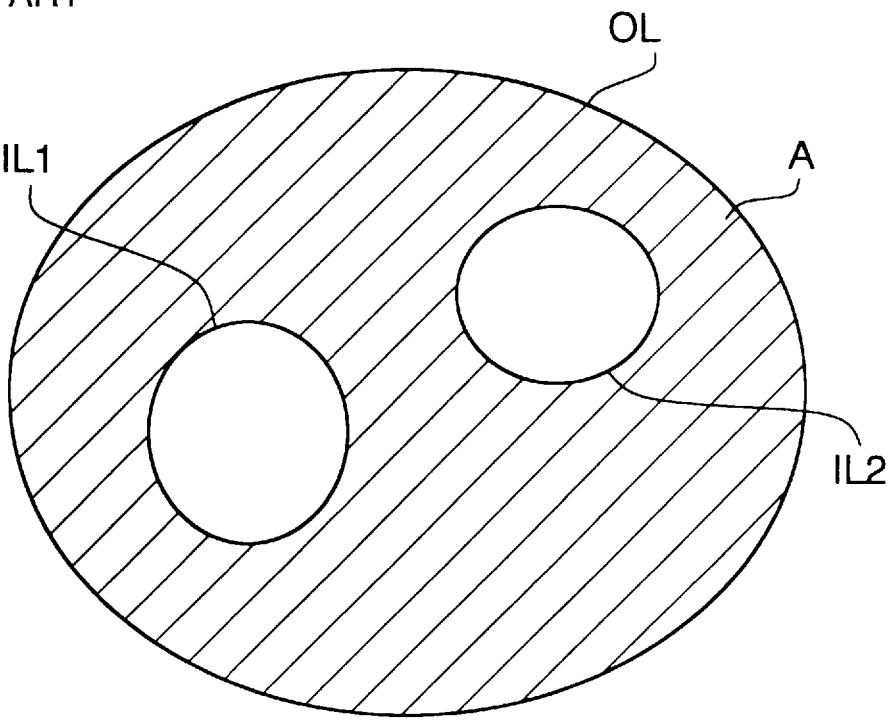
FIG. 6A PRIOR ART
FIGS. 6A, 6B and 7 show the conventional sewing data creating process for underlying stitch area.
Figure 6B:
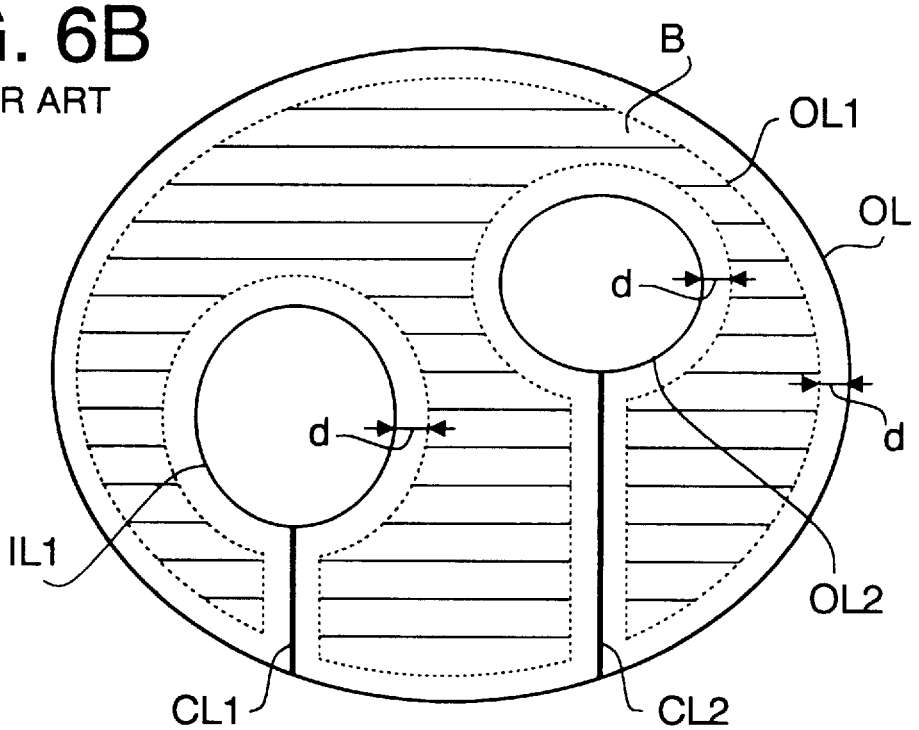
FIG. 6B PRIOR ART

At S12, if the counter value c is equal to the total number j of the defining points, i.e., if a connecting line cannot be determined with respect to any one of the defining points of an inner outline, an error message as shown in FIG. 5 is displayed on the screen of the CRT 19 at S13. Then, the data creating process for creating the sewing data to be used for forming the underlying stitches is terminated. Thereafter, the user can change the positions, sizes, shapes of the outer and/or inner outlines with reference to the displayed error message, and restart the sewing data creating process again to create the sewing data based on the revised data.

As described above, the connecting line determined at S5 is examined at S6 to determine whether the connecting line is valid or not based on the positional relationship between the connecting line and the other inner outlines. If the connecting line is determined to be invalid, a new connecting line is determined and the validity is checked. Based on only the valid connecting lines, the closed area of the underlying stitches is defined at S9. Therefore, even for the arrangement of the inner outlines as shown in FIG. 4A or 4B, an appropriate sewing data can be created.

The present invention may be embodied in other specific forms without departing from the spirit of essential characteristics thereof. Therefore, the embodiment described above is to be considered in all respects as illustrative and not restrictive, the scope of the invention being indicated by the appended claims rather than by the foregoing description and all changes which come within the meaning and range of equivalency of the claims are therefore intended to be embraced therein.

For example, in the embodiment, the connecting line starts from the lowest or highest point of the inner outline. It may be possible to start the connecting line from the leftmost point or the rightmost point. Accordingly, when a connecting line is determined to be invalid and another connecting line is to be set, the connecting line can be start from any other point of the inner outline. Alternatively or optionally, it may be modified such that the user select the starting point (i.e., the reference point) of the connecting line.

In the embodiment, the outline of the closed area is determined to be apart from the outer outline, inner outlines and connecting lines by the predetermined amount d. It may be possible to modify the embodiment such that the amount d can be changed by the user by inputting a new value, or selecting one of predetermined values.

In the embodiment, the direction of the stitches is determined. However, the embodiment can be modified such that the direction of stitches is changeable.

Further, in the embodiment, the embroidery data processing device creates the sewing data, and transmits the sewing data to the embroidery sewing machine. The embodiment can be modified such that the embroidery data processing device transmits data of the outlines, sewing attribution and the like to the sewing machine, and the sewing data is created inside the sewing machine.

The present disclosure relates to subject matter contained in Japanese Patent Application No. HEI 08-338169, filed on Dec. 18, 1996, which is expressly incorporated herein by reference in its entirety.

What is claimed is:

1. An embroidery data processing device for processing sewing data used for forming underlying stitches in a closed embroidery area defined between an inside of an outer outline and an outside of a plurality of inner outlines, said inner outlines being included inside said outer outline, said embroidery data processing device comprising:

a connecting line determining system which determines a connecting line for each of said inner outlines, said connecting line connecting each of said inner outlines with one of said outer outline and another inner outline;

an evaluating system which determines whether said connecting line determined for each of said inner outlines is valid or invalid, based on a positional relationship of said connecting line extending from an inner outline with respect to the other inner outlines; and an outline creating system which creates an outline of an underlying stitch area which is to be filled with said underlying stitches, in accordance with said outer outline, said inner outlines and said connecting line for each of said inner outlines.

2. The embroidery data processing device according to claim 1, wherein said evaluating system determines whether said connecting line determined for each of said inner outlines is valid or invalid based on a distance between said connecting line and the other inner outlines.

3. The embroidery data processing device according to claim 2, wherein said evaluating system determines whether said distance is greater than a predetermined amount, said connecting line being determined as invalid if said distance is less than said predetermined amount.

4. The embroidery data processing device according to claim 1, wherein said connecting line determining system determines another connecting line for said inner outline if said connecting line is determined as an invalid connecting line.

5. The embroidery data processing device according to claim 4, wherein each of said inner outlines are regarded as successively connected line segments which are connected at defining points, said connecting line extending from one of said defining points.

6. The embroidery data processing device according to claim 1, further comprising an indicating system which indicates information regarding validity of said connecting line.

7. The embroidery data processing device according to claim 6, wherein said indicating system comprises a displaying device which displays a message regarding validity or invalidity of said connecting line.

8. The embroidery data processing device according to claim 7, wherein said displaying device displays an error message when said connecting line for at least one of said inner outlines is determined as an invalid connecting line.

9. The embroidery data processing device according to claim 1, wherein said outline creating system creates said outline of said underlying stitch area if said connecting line determined for each inner outline is determined as valid.

10. The embroidery data processing device according to claim 9, further comprising data creating system which creates said sewing data used for forming said underlying stitches based on said outline of said underlying stitch area.

11. A method for processing sewing data used for forming underlying stitches in a closed embroidery area defined between an inside of an outer outline and an outside of a plurality of inner outlines, said inner outlines being included inside said outer outline, said method comprising the steps of:

first determining step of determining a connecting line for each of said inner outlines, said connecting line connecting each of said inner outlines with one of said outer outline and another inner outline;

a second determining step of determining whether said connecting line determined for each of said inner outlines is valid or invalid based on a positional relationship of said connecting line extending from an inner outline with respect to the other inner outlines; and creating an outline of an underlying stitch area which is to be filled with said underlying stitches in accordance with said outer outline, said inner outlines and said connecting line for each of said inner outlines.

12. The method for sewing data according to claim 11, wherein said second determining step determines whether said connecting line determined for each of said inner outlines is valid or invalid based on a distance between said connecting line and the other inner outlines.

13. The method for sewing data according to claim 12, wherein said second determining step determines whether said distance is greater than a predetermined amount, said connecting line being determined to be invalid if said distance is less than said predetermined amount.

14. The method for sewing data according to claim 11, wherein said first determining step determines another connecting line for said inner outline if said connecting line is determined to be an invalid connecting line.

15. The method for sewing data according to claim 11, further comprising a step of indicating information regarding validity of said connecting line.

16. The method for sewing data according to claim 11, wherein said creating step creates said outline of said underlying stitch area if said connecting line determined for each inner outline is determined to be valid.

17. A computer readable medium for storing a computer program, said computer readable medium comprising a computer program providing a method used for forming underlying stitches in a closed embroidery area defined between an inside of an outer outline and an outside of a plurality of inner outlines, said inner outlines being included inside said outer outline, said method comprising the steps of:

a first determining step of determining a connecting line for each of said inner outlines, said connecting line connecting each of said inner outlines with one of said outer outline and another inner outline;

a second determining step of determining whether said connecting line determined for each of said inner outlines is valid or invalid based on a positional relationship of said connecting line extending from an inner outline with respect to the other inner outlines; and creating an outline of an underlying stitch area which is to be filled with said underlying stitches in accordance with said outer outline, said inner outlines and said connecting line for each of said inner outlines.

18. The computer readable medium according to claim 17, wherein said second determining step determines whether said connecting line determined for each of said inner outlines is valid or invalid based on whether a distance between said connecting line and the other inner outlines is greater than a predetermined amount, said connecting line being determined to be invalid if said distance is less than said predetermined amount.

19. The computer readable medium according to claim 17, wherein said first determining step determines another connecting line for said inner outline if said connecting line is determined to be an invalid connecting line.

20. The computer readable medium according to claim 17, wherein said creating step creates said outline of said underlying stitch area if said connecting line determined for each inner outline is determined to be valid.

* * * * *

UNITED STATES PATENT AND TRADEMARK OFFICE

CERTIFICATE OF CORRECTION

PATENT NO. : 5,875,725
DATED : March 2, 1999
INVENTOR(S) : Masahiro Mizuno

It is certified that error appears in the above-identified patent and that said Letters Patent is hereby corrected as shown below:

On the title page, Item [75], correct the patent to read:

Inventor: Masahiro Mizuno, Nagoya, Japan

Signed and Sealed this

Sixth Day of July, 1999

*Attest:*

Q. TODD DICKINSON

*Attesting Officer*

*Acting Commissioner of Patents and Trademarks*